United States Patent [19]

Blot

[11] Patent Number: 4,632,249

[45] Date of Patent: Dec. 30, 1986

[54] LATERAL PACKAGING FOR THE GROUPING AND HOLDING TOGETHER OF SUPERPOSED ARTICLES

[76] Inventor: Michel Blot, "La Blotinière" - 6 rue de La Barboire, Moricq - 85750 - Angles, France

[21] Appl. No.: 694,396

[22] PCT Filed: Apr. 20, 1984

[86] PCT No.: PCT/FR84/00113

§ 371 Date: Dec. 21, 1984

§ 102(e) Date: Dec. 21, 1984

[87] PCT Pub. No.: WO84/04288

PCT Pub. Date: Nov. 8, 1984

[30] Foreign Application Priority Data

Apr. 22, 1983 [FR] France ..... 83 06683

[51] Int. Cl.[4] ..... B65D 73/00; B65D 21/00

[52] U.S. Cl. ..... 206/431; 206/485; 206/499

[58] Field of Search ..... 206/427, 499, 503, 485, 206/431

[56] References Cited

U.S. PATENT DOCUMENTS

| | | | |
|---|---|---|---|
| 2,256,995 | 9/1941 | Andres | 206/485 |
| 3,339,725 | 9/1967 | Hamilton | 206/499 |
| 3,384,223 | 5/1968 | Manizza | 206/499 |
| 4,141,448 | 2/1979 | Mascia . | |

FOREIGN PATENT DOCUMENTS

| | | | |
|---|---|---|---|
| 1469554 | 12/1965 | France | 206/485 |
| 2471294 | 12/1979 | France . | |
| 1436935 | 12/1979 | France . | |
| 6503716 | 10/1965 | Netherlands | 206/485 |

*Primary Examiner*—Joseph Man-Fu Moy

*Attorney, Agent, or Firm*—Wender Murase & White

[57] ABSTRACT

Lateral packaging for the grouping and holding together of articles superposed in their natural orientation, and presenting a rim which is inserted in a slot of a lateral band with a plurality of sides defined by folding lines.

The band is interconnected at its upper part by a panel covering the upper face of the articles, and a series of slots is provided between said panel and said lateral band slots receive the angles or corners of the rims of the articles.

3 Claims, 4 Drawing Figures

LATERAL PACKAGING FOR THE GROUPING AND HOLDING TOGETHER OF SUPERPOSED ARTICLES

BACKGROUND AND SUMMARY

An object of the present invention is to provide a lateral packaging for the grouping and holding together of superimposed articles.

The present invention is an improvement over the arrangement described in U.S. Pat. No. 4,467,918 which relates to a packaging device for the grouping and holding together of superimposed articles in their natural direction and for presenting a rim which is engaged in a slot of the a lateral band having a plurality of sides defined by folding lines perpendicular to the slots. The lateral band surrounding the periphery of a group of articles is provided with at least two series of superimposed parallel slots in which angles or corners of the rims of the articles superimposed in their natural direction are engaged, the slots being provided an alternate manner on the sides of the band.

An object of the present invention is to improve this packaging with a view to protecting the upper face of one of the groups of articles.

According to the present invention a lateral band is interconnected at its upper part by a panel covering an upper face of the articles and a plurality of slots are provided between the panel and the lateral band, said slots receiving the angles or corners of the rims of the articles.

BRIEF DESCRIPTION OF THE DRAWINGS

Other characteristics and advantages of the invention will be more readily understood on reading the following description of several embodiments with reference to the accompanying drawings, in which.

DETAILED DESCRIPTION OF THE INVENTION

Figure 1:
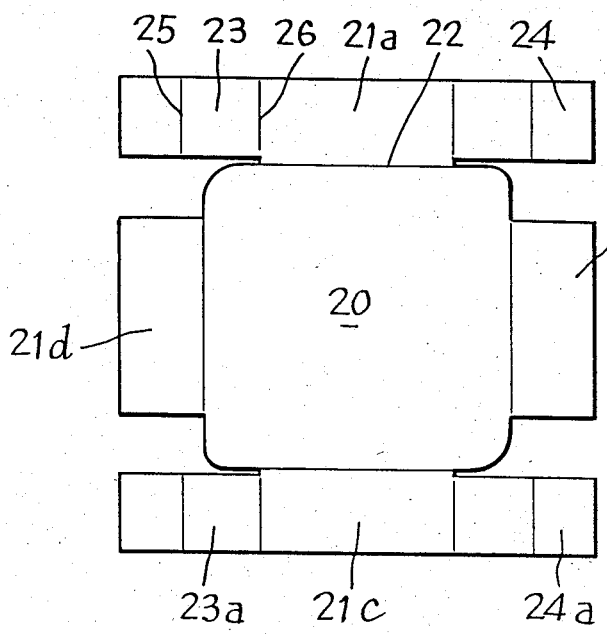
FIG. 1 is a plan view of one embodiment of a molding of the packaging according to the invention.
Figure 2:
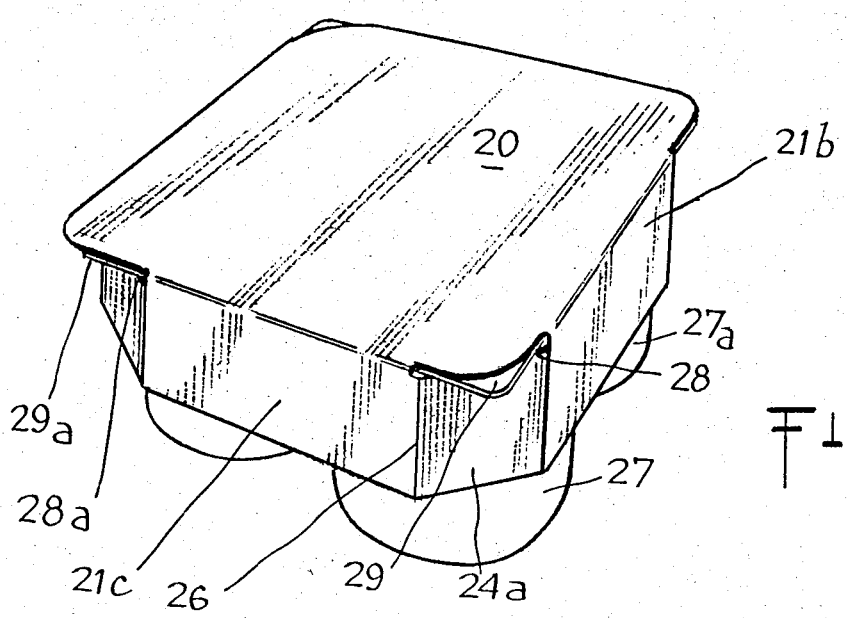
FIG. 2 is a perspective view of the packaging device produced with the molding illustrated in FIG. 1.

Referring first to FIG. 1, there is illustrated a molding suitably cut out and slotted, which molding comprises a central panel 20 with four sides which are joined to lateral panels 21*a*, 21*b*, 21*c*, 21*d* at folding lines 22. Two of the opposed panels 21*a*, 21*c* each comprise two tabs 23, 24 and 23*a*,24*a* from which they are separated by a folding line 26, said tabs having in their middle part a folding line 25. Said molding, after suitable folding about folding lines 22, 25 and 26 of the different panels is placed over a group of articles such as 27, 27*a*, which, in the example illustrated in FIG. 2, numbers four.

As a result, the central upper panel 20 being laid over the upper face of the articles 27, 27*a*, panels 21*a*, 21*d* are folded over folding lines 22 so that they constitute with the tabs 23, 24 and 23*a* 24*a* a lateral band with a plurality of sides surrounding the group of articles. The ends of the tabs 23, 24 and 23*a*, 24*a* which are folded down under panels 21*b*, 21*d*(FIG. 2) are secured over same by a known means such as an adhesive. It is possible, with this particular arrangement to provide, between the central panel 20 and the so constituted band, slots 28, 28*a* which are situated at the angles of panel 20 and in which are engaged the angles or corners 29 of the rims of the articles 27, 27*a*.

Figure 3:
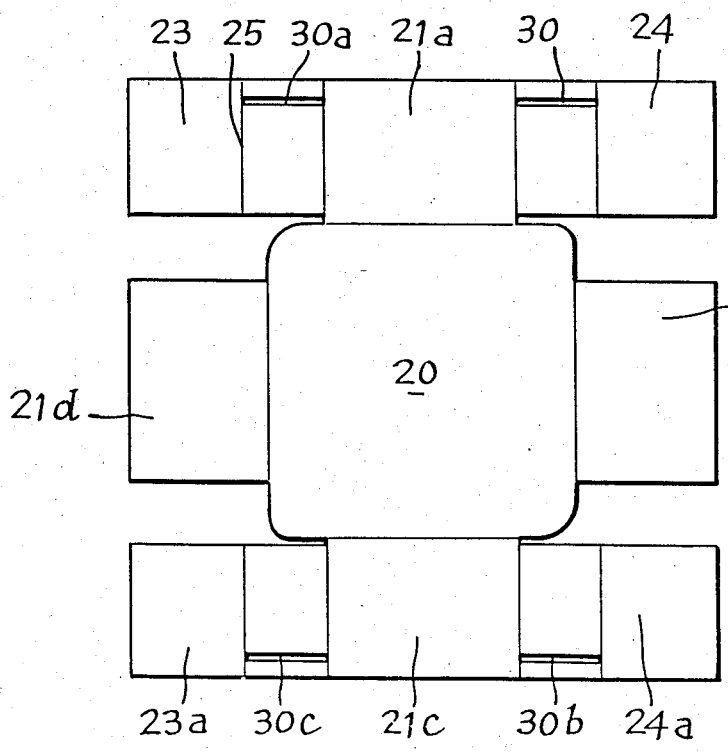
FIG. 3 is a plan view of another embodiment of a molding for two groups of superposed articles.

FIG. 3 shows another embodiment of a molding in which slots 30, 30*a*, 30*b*, 30*c* are provided in the tabs 23, 24 and 23*a*, which slots are situated at the base of said tabs along the same axis.

Figure 4:
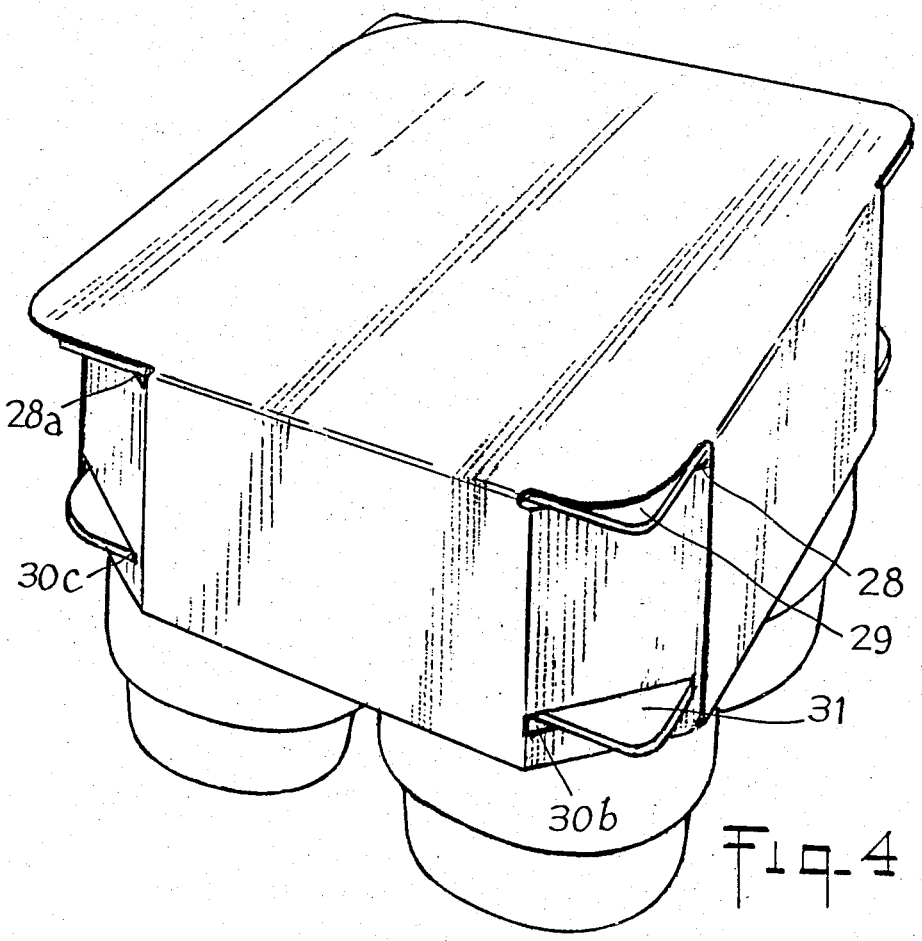
FIG. 4 is a perspective view of the packaging device produced with the molding illustrated in FIG. 3.

When said molding is folded over two groups of superposed articles as illustrated in FIG. 4, the packaging device is formed having two series of parallel slots 28 and 30 in which are engaged the angles or corners 29 and 31 of the rims of the two groups of superposed articles.

Obviously, the invention is not restrictive and anyone skilled in the art can bring any modification thereto without departing from the scope of the invention.

I claim:

1. Packaging for grouping and holding together, in a suspended and vertically spaced relationship, vertically stacked upper and lower arrays of articles having rims with corners, said packaging comprising:

a lateral band having a plurality of sides defined by folding lines, said lateral band defining an upper and a lower series of parallel and vertically spaced slots for engaging the corners of the rims of said articles, said slots being disposed on the sides of the band and extending generally perpendicularly from said folding lines;

a panel for covering said upper array of articles, said lateral band being interconnected at an upper part thereof by said panel;

said upper series of slots being disposed at an upper edge of the lateral band adjacent to said panel and operable to receive the corners of the rims of the upper array of articles, said lower series of slots being operable to receive the corners of the rims of the lower array of articles.

2. The packaging according to claim 1, wherein said panel has four sides and said lateral band comprises four side panels, each joined by means of a folding line to one of the four sides of the panel, two of said side panels being disposed opposite each other and including on either side thereof two tabs in which said slots are disposed, said tabs being separated from the side panel by a first folding line and having in a middle part thereof a second folding line, whereby an end part of said tabs may be fixed the other two opposite panels.

3. The packaging according to claim 2 wherein the tabs in which said slots are disposed are inclined with respect to said side parallels whereby said top panel is operable to support said side panels for protecting said articles.

* * * * *